US012285667B1

(12) United States Patent
Edmonson et al.

(10) Patent No.: US 12,285,667 B1
(45) Date of Patent: Apr. 29, 2025

(54) APPARATUS FOR AFFIXING AN IMU TO THE FACE OF A GOLF CLUB FOR SENSOR CALIBRATION AND CLUB MEASUREMENT

(71) Applicant: SkyHawke Technologies, LLC, Ridgeland, MS (US)

(72) Inventors: Richard C. Edmonson, Ridgeland, MS (US); Moses Phinehas Victor, Ridgeland, MS (US); Jeremy Rittenhouse, Ridgeland, MS (US)

(73) Assignee: SkyHawke Technologies, LLC, Ridgeland, MS (US)

( * ) Notice: Subject to any disclaimer, the term of this patent is extended or adjusted under 35 U.S.C. 154(b) by 0 days.

(21) Appl. No.: 19/012,321

(22) Filed: Jan. 7, 2025

(51) Int. Cl.
*A63B 60/42* (2015.01)
*A63B 60/46* (2015.01)
*A63B 53/04* (2015.01)

(52) U.S. Cl.
CPC ..... *A63B 60/42* (2015.10); *A63B 60/46* (2015.10); *A63B 53/0445* (2020.08); *A63B 2209/08* (2013.01); *A63B 2220/44* (2013.01)

(58) Field of Classification Search
CPC ..... A63B 60/42; A63B 60/46; A63B 2220/30; A63B 2220/40; A63B 2220/44; A63B 69/36; A63B 69/3632; A63B 2220/50; A63B 2220/83; A63B 2220/833; A63B 2225/50; A63B 2209/08; A63B 53/0445
See application file for complete search history.

(56) References Cited

U.S. PATENT DOCUMENTS

| | | | | |
|---|---|---|---|---|
| 3,075,773 | A * | 1/1963 | Kaufman | A63B 69/3632 116/284 |
| 5,385,349 | A * | 1/1995 | Marshall | A63B 53/047 473/409 |
| 5,441,270 | A * | 8/1995 | Williams | A63B 69/3685 473/409 |
| 8,303,428 | B2 | 11/2012 | Wagen et al. | |
| 8,956,238 | B2 | 2/2015 | Boyd et al. | |
| 9,395,385 | B2 | 7/2016 | Parke et al. | |
| 9,403,077 | B2 | 8/2016 | Ota et al. | |
| 9,950,237 | B2 | 4/2018 | Kline et al. | |
| 10,549,172 | B2 | 2/2020 | Bittner | |
| 11,007,413 | B2 | 5/2021 | Golden et al. | |
| 2005/0227775 | A1 | 10/2005 | Cassady et al. | |
| 2007/0015607 | A1 * | 1/2007 | Hot | A63B 60/62 150/160 |
| 2010/0212172 | A1 * | 8/2010 | Spitzer | G01B 11/24 382/141 |
| 2015/0143870 | A1 | 5/2015 | Shibuya | |
| 2016/0001143 | A1 * | 1/2016 | Yang | A63B 60/50 473/333 |
| 2017/0122775 | A1 * | 5/2017 | Ishikawa | G01D 11/30 |

* cited by examiner

*Primary Examiner* — Raleigh W Chiu
(74) *Attorney, Agent, or Firm* — NEO IP

(57) ABSTRACT

An apparatus including a substrate with a front face with circular walls defining a central area for receiving an inertial measurement unit (IMU). The apparatus includes one or more tabs and a pad extending from a back face for extending into grooves in a club face of a golf club, keeping the apparatus level on the club face. The apparatus also includes a magnet between the circular walls of the central area for adhering to the metal club face.

20 Claims, 9 Drawing Sheets

APPARATUS FOR AFFIXING AN IMU TO THE FACE OF A GOLF CLUB FOR SENSOR CALIBRATION AND CLUB MEASUREMENT

BACKGROUND OF THE INVENTION

1. Field of the Invention

The present invention relates to sensors for determining the orientation of a golf club, and more specifically to apparatuses for affixing orientation sensors to a club face of a golf club.

2. Description of the Prior Art

It is generally known in the prior art to measure the loft, lie, and length of a golf club. This is done using mechanical gauges or tools and taking manual measurements. It is also generally known in the art to place sensors on a golf club, such as accelerometers and gyroscopes, to measure the swing parameters of a golfer hitting a golf ball. These sensors, also known as an initial measurement unit, or IMU, are generally placed on the grip end of a golf club. Prior art patent documents include the following:

U.S. Pat. No. 8,956,238 for Golf clubs and golf club heads by inventors Boyd et al., filed Sep. 30, 2011 and issued Feb. 17, 2015, discloses golf clubs including a golf club head and a shaft configured to engage with the golf club head which includes a grip engaged with the shaft. Further, the golf club may include a monitoring device, which includes a sensor and a transmitter. Additionally, the monitoring device may be configured to determine data related to the characteristics of a golf swing. Further, the monitoring device may be configured to transmit the data related to the characteristics of a golf swing to a remote computer.

U.S. Pat. No. 9,395,385 for Method and apparatus for determining a relative orientation of points on a rigid body by inventors Parke et al., filed Jan. 17, 2013 and issued Jul. 19, 2016, discloses an inertial measurement unit is affixed to a rigid body. The inertial measurement includes a gyroscope that measures a first angular velocity and an angular acceleration; a first accelerometer that measures a first acceleration; a communications unit that receives a measurement signal, the measurement signal including a second acceleration transmitted from a second accelerometer, the second accelerometer being affixed to the rigid body; and a controller that calculates a relative orientation of the inertial measurement unit and the second accelerometer, and a distance separating the inertial measurement unit and the second accelerometer.

U.S. Pat. No. 9,950,237 for System, method, and apparatus for monitoring sporting apparatus and users thereof by inventors Kline et al., filed Apr. 23, 2015 and issued Apr. 24, 2018, discloses a system comprising one or more monitoring devices that may communicate with a mobile device or a wearable device worn by a user of a sporting apparatus. The system may enable motion data specific to motion of the sporting apparatus to be conveniently captured and transmitted, and displayed on the wearable device. The system may include functionality to permit disablement of the motion detecting, transmission, and/or displaying functions at times when such functions are not permitted to be used, and to record the date, time, and location when such functions have been disabled to permit verification thereof by a governing body or sporting organization. The system may further include a learning module enabling monitored motion of the object to be correlated to monitored motion of the user such that predictive motion of the sporting object based only on monitored motion of the user may be obtained and displayed.

US Patent Pub. No. 2015/0143870 for Azimuth angle calibration method and motion analysis apparatus by inventor Shibuya, filed Nov. 7, 2014 and published May 28, 2015, discloses a motion analysis apparatus including a first calculation unit that calculates a first vector on a node in an absolute coordinate system using an output from a first inertial sensor attached to one of two rigid bodies linked by the node having a multiple degrees of freedom, a second calculation unit that calculates a second vector on the node in the absolute coordinate system using an output from a second inertial sensor attached to the other one of the rigid bodies; and a third calculation unit that calculates a difference in directions of the first vector and the second vector.

U.S. Pat. No. 9,403,077 for Golf swing analyzing apparatus and method of analyzing golf swing by inventors Ota et al., filed Oct. 1, 2013 and issued Aug. 2, 2016, discloses an invention relating to a golf swing analyzing apparatus, comprising: an arithmetic section operating to process the output of a first inertial sensor and the output of a second inertial sensor to calculate a relative angle between a forearm of a golfer and a golf club, the first inertial sensor being attached to a portion of the upper body of the golfer, the second inertial sensor being attached to the golf club.

US Patent Pub. No. 2005/0227775 for Method and system for calibrating sports implement inertial motion sensing signals by inventors Cassady et al., filed May 24, 2005 and published Oct. 13, 2005, discloses techniques for calibrating club-like sports implementing inertial motion sensing signals. The disclosed method and system generate calibrated output of a motion sensing circuit, which circuit includes an inertial measurement unit and associates with a club-like sports implement. The method and system generate a plurality of calibration coefficients along a predetermined set of axes, said axes corresponding to the axes of movement for said club-like sports implement. The calibration coefficients are applied to a sensing program that operates in association with the inertial measurement unit. The method and system generate sensed motion data using the inertial measurement unit, which includes data relative to the predetermined set of axes. The data is in response to motion of the club-like sports implement. Furthermore, the method and system calibrate the sensed motion data using said plurality of calibration coefficients.

U.S. Pat. No. 8,303,428 for Short game training device for use with golf club by inventors Wagen et al., filed Feb. 15, 2008 and issued Nov. 6, 2012, discloses a short game training device for use with a golf club comprising an two-axis linear accelerometer, a fastener for removably attaching the accelerometer to the golf club head H so that the X and Y axes of the accelerometer are disposed approximately parallel with the club face and oriented at approximately a forty-five degree angle with respect to a substantially vertical plane V containing the aim line A established when addressing the golf ball G with the club face aligned perpendicularly to the aim line A, a detectable alarm, and a microprocessor for calculating differences in forces measured by the X and Y axes during a timed interval subsequent to positioning the club and for activating the alarm when the differences exceed a selected threshold.

U.S. Pat. No. 11,007,413 for Wedge golf club fitting system by inventors Golden et al., filed Oct. 23, 2019 and issued May 18, 2021, discloses a system and method of fitting golf clubs, and more particularly, the systems and method related to wedge type golf clubs, having multiple sole configurations and/or bounce angles. More specifically, the present invention is directed to system and methods that enable a player to quantify the performance of the golf club's sole interaction with the ground and to determine the sole configuration and bounce angle that provides the most optimal shot performance.

U.S. Pat. No. 10,549,172 for Sensor for improving and training putting technique by inventor Bittner, filed Jan. 8, 2018 and issued Feb. 4, 2020, discloses a putting stroke sensor attachable to a putter head for measuring characteristics of a putting stroke. A motion sensor integrated circuit is configured to measure acceleration of the putter head along several axes and rotation of the putter head around the several axes during a putting stroke. A processor is programmed to determine a speed, a position and an orientation of the putter head at selective intervals during the putting stroke.

SUMMARY OF THE INVENTION

The present invention relates to sensors for determining the orientation of a golf club, and more specifically to apparatuses for affixing orientation sensors to a club face of a golf club.

It is an object of this invention to provide an apparatus for affixing an IMU to a club face in order to better perform calibration for analysis of a golf swing.

In one embodiment, the present invention includes an apparatus for affixing a sensor to a golf club face, including a substrate, a circular wall extending from a front surface of the substrate, defining a hollow central area of the substrate, a magnet disposed in the hollow central area of the substrate, and one or more tabs extending from a back surface of the substrate, each including extensions configured to be inserted into and engage with one or more grooves on the golf club face or an edge of the club face, wherein an inner surface of the circular wall includes threading configured to engage with threading of an outer shell of inertial measurement unit (IMU).

In another embodiment, the present invention includes an apparatus for affixing a sensor to a golf club face, including a substrate, a circular wall extending from a front surface of the substrate, defining a hollow central area of the substrate, a magnet disposed in the hollow central area of the substrate, one or more tabs extending from a back surface of the substrate configured to engage with one or more grooves on the golf club face or an edge of the golf club face, and a pad extending from the back surface of the substrate configured to contact the golf club face, wherein an inner surface of the circular wall includes threading configured to engage with threading of an outer shell of inertial measurement unit (IMU).

In yet another embodiment, the present invention includes an apparatus for affixing a sensor to a golf club face, including a substrate, a circular wall extending from a front surface of the substrate, defining a hollow central area of the substrate, a magnet disposed in the hollow central area of the substrate, and one or more tabs extending from a back surface of the substrate configured to engage with one or more grooves on the golf club face or an edge of the golf club face, wherein an inner surface of the circular wall includes threading configured to engage with threading of an outer shell of inertial measurement unit (IMU), and wherein, when attached to the apparatus, side walls of the outer shell of the IMU are configured to rest on the front surface of the substrate, between the circular wall and the magnet.

In still another embodiment, the present invention includes an apparatus for affixing a sensor to a golf club face, including two substrates, wherein the first substrate includes a circular wall extending from a front surface of the substrate, defining a hollow central area of the substrate, a magnet disposed in the hollow central area of the substrate, and one or more tabs extending from a back surface of the substrate configured to engage with the second substrate and the second substrate includes a bottom surface that is curved to rest on the curved surface of a golf club, recessed areas in the top surface of the substrate to receive the one or more tabs of the first substrate, and one or more tabs extending from a back surface of the substrate configured to engage with one or more grooves on the golf club face or with the edge of the edge.

These and other aspects of the present invention will become apparent to those skilled in the art after a reading of the following description of the preferred embodiment when considered with the drawings, as they support the claimed invention.

DETAILED DESCRIPTION

Figure 1:
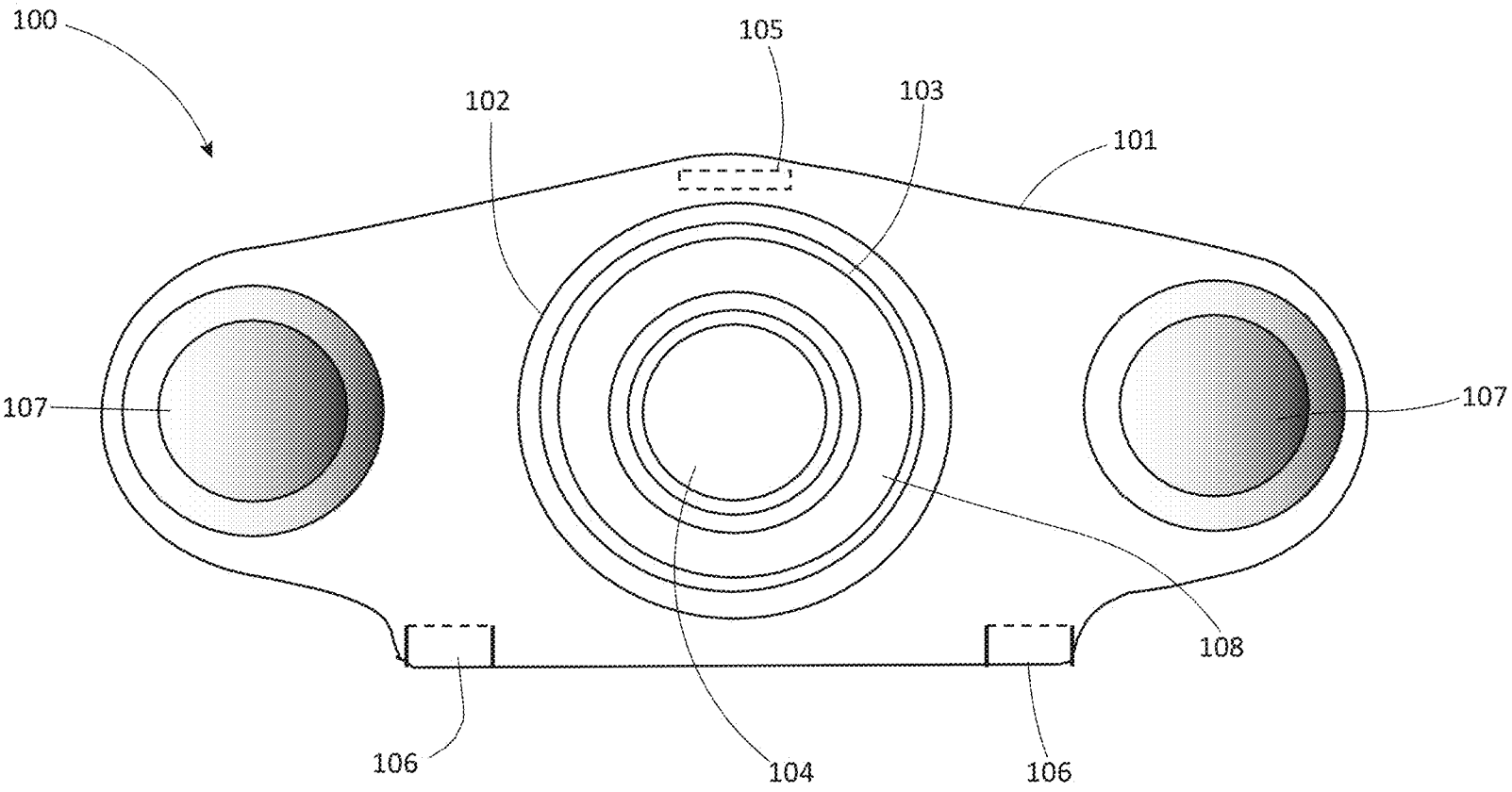
FIG. 1 illustrates a front orthogonal view of an apparatus for holding an inertial measurement unit (IMU) on a golf club face according to the present invention.

The present invention is generally directed to sensors for determining the orientation of a golf club, and more specifically to apparatuses for affixing orientation sensors to a club face of a golf club.

In one embodiment, the present invention includes an apparatus for affixing a sensor to a golf club face, including a substrate, a circular wall extending from a front surface of the substrate, defining a hollow central area of the substrate, a magnet disposed in the hollow central area of the substrate, and one or more tabs extending from a back surface of the substrate, each including extensions configured to be inserted into and engage with one or more grooves on the golf club face or an edge of the club face, wherein an inner surface of the circular wall includes threading configured to engage with threading of an outer shell of inertial measurement unit (IMU).

In another embodiment, the present invention includes an apparatus for affixing a sensor to a golf club face, including a substrate, a circular wall extending from a front surface of the substrate, defining a hollow central area of the substrate, a magnet disposed in the hollow central area of the substrate, one or more tabs extending from a back surface of the substrate configured to engage with one or more grooves on the golf club face or an edge of the golf club face, and a pad extending from the back surface of the substrate configured to contact the golf club face, wherein an inner surface of the circular wall includes threading configured to engage with threading of an outer shell of inertial measurement unit (IMU).

In yet another embodiment, the present invention includes an apparatus for affixing a sensor to a golf club face, including a substrate, a circular wall extending from a front surface of the substrate, defining a hollow central area of the substrate, a magnet disposed in the hollow central area of the substrate, and one or more tabs extending from a back surface of the substrate configured to engage with one or more grooves on the golf club face or an edge of the golf club face, wherein an inner surface of the circular wall includes threading configured to engage with threading of an outer shell of inertial measurement unit (IMU), and wherein, when attached to the apparatus, side walls of the outer shell of the IMU are configured to rest on the front surface of the substrate, between the circular wall and the magnet.

In still another embodiment, the present invention includes an apparatus for affixing a sensor to a golf club face, including two substrates, wherein the first substrate includes a circular wall extending from a front surface of the substrate, defining a hollow central area of the substrate, a magnet disposed in the hollow central area of the substrate, and one or more tabs extending from a back surface of the substrate configured to engage with the second substrate and the second substrate includes a bottom surface that is curved to rest on the curved surface of a golf club, recessed areas in the top surface of the substrate to receive the one or more tabs of the first substrate, and one or more tabs extending from a back surface of the substrate configured to engage with one or more grooves on the golf club face or with the edge of the edge.

It is generally known in the art to measure the loft, lie, and length of a golf club. This is done using mechanical gauges or tools and taking manual measurements. It is also generally known in the art to place sensors on a golf club, such as accelerometers and gyroscopes, to measure the swing parameters of a golfer hitting a golf ball. These sensors, also known as an initial measurement unit, or IMU, are generally placed on the grip end of a golf club. To accurately measure a golf swing, the sensors need to know the location of the face of the golf club relative to the sensor. It is known in the art to calibrate the sensors relative to the club face. One such method known in the art, described in U.S. Pat. No. 9,395,385 is to place a club face IMU on the face of the golf club and calibrate the location differential between the club face IMU and the grip end IMU.

A challenge faced by prior art devices is that the club face IMU placed on the clubface for calibration must be removed for the golfer to play golf. Thus, it cannot be permanently attached. A second challenge is that the club face IMU must be stably placed on the clubface during calibration for accuracy. If the club face IMU moves or wobbles, accuracy is compromised. This is a challenge because the faces of golf clubs are not uniform. The iron clubs tend to be more uniform and relatively flat with consistent grooves, whereas the faces of the wood clubs tend to have a slightly rounded face and inconsistent grooves. The faces of putters also vary considerably.

One issue with many prior art devices is that the alignment of the sensors in the club face IMU relative to the club face must be known beforehand. Because loft and lie club measurements are taken with the grooves of the clubface parallel to the ground, in some cases the sensors in the second IMU must be aligned to the grooves of the clubface. A shortcoming of some prior art systems is that a smartphone or other similar smart mobile device is used as the club face IMU. While smartphones and other similar larger devices contain IMU sensors, the sensors are not uniformly located within different makes and models of smartphones or mobile devices. Accordingly, because smartphones and mobile devices are generally considerably larger than the face of a golf club and the exact location of their sensors varies within the smartphone or other device are often unclear, they are both difficult to place on the smaller clubface with the location of the IMU in a preferred position, creating accuracy issues.

The present invention solves the problems of the prior art devices by providing an apparatus housing an IMU that is temporarily affixable to the face of a golf club to provide a stable platform with a known orientation and location on the clubface for calibration of the principal IMU on the grip end of the club and for measuring a golf club, particularly loft, lie, and length.

Referring now to the drawings in general, the illustrations are for the purpose of describing one or more preferred embodiments of the invention and are not intended to limit the invention thereto.

The present invention is directed to an apparatus for holding an IMU to the face of a golf club. The IMU of the present invention is able to be any standard IMU device and is able to include accelerometer, gyroscope, and/or magnetometer subcomponents, such that the device is sensitive to forces along different axes (e.g., a 2-axis, or 3-axis IMU), angular rotation rates, and an orientation of the IMU. The orientation of the IMU is able to be determined, at rest, by the distribution of the rest gravitational force on each axis of the IMU, though the orientation of the IMU device relative to the attached object needs to be understood in order for this orientation measurement to be accurate. The apparatus of the present invention is able to affix the apparatus to the golf club face with limited shifting, such that the orientation of the IMU relative to the club face is able to be known over time for calibration purposes before measuring a golf swing.

FIG. 1 illustrates a front orthogonal view of the apparatus (without an IMU attached) according to the present invention. The apparatus 100 includes a substrate 101 that comprises the body of the apparatus 100. Walls extend from a center portion of a front face of the apparatus 100 to define an area that receives and holds the IMU. The walls include an outside circular wall 102 affixed to the substrate 101 and an inside, threaded wall 103. A magnet 104 is positioned in the middle of the walls and is, in one embodiment, glued to the substrate 101. The threads of the inner wall 103 receive and hold in place the IMU. The magnet 104 helps to secure the apparatus 100 to a face of a golf club. The magnet 104 is sized and positioned to leave a space 108 between the magnet 104 and the outer wall 102 to receive the threads of IMU. One of ordinary skill in the art will understand that while substrate 101, shown in FIG. 1, includes a flat bottom surface placed on the golf club face, the surface is also able to be curved to accommodate curved club faces.

Two tabs 106, proximate to the bottom of the substrate 101, extend out from a back of the substrate 101. One pad 105, proximate to the top of the substrate 101, extends out from the back of the substrate 101 as well. The tabs 106 are designed to partially fit within grooves of a golf club face, and the pad 105 helps level the substrate 101 on the clubface.

In one embodiment, a left side and a right side of the front face of the substrate 101 both include recessed areas 107.

Figure 2:
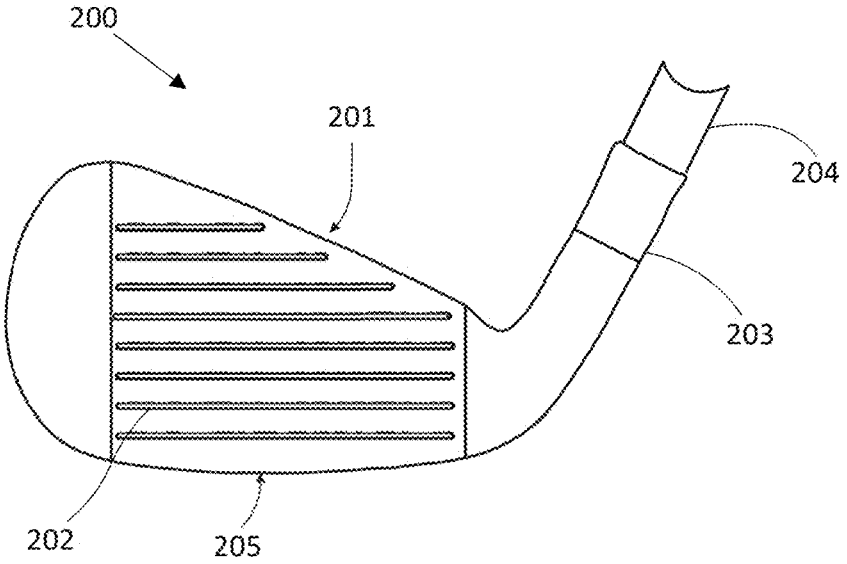
FIG. 2 illustrates a front view of a lower portion of a golf club to which an apparatus of the present invention is able to be attached.
Figure 3A:
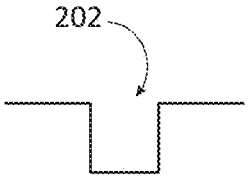
FIG. 3A illustrates a side profile view of a golf club face groove having a square profile.
Figure 3B:
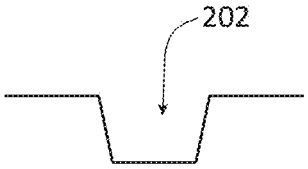
FIG. 3B illustrates a side profile view of a golf club face groove having a chamfered profile.
Figure 3C:
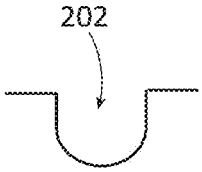
FIG. 3C illustrates a side profile view of a golf club face groove having a rounded profile.
Figure 3D:
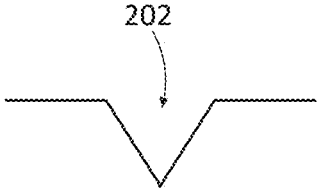
FIG. 3D illustrates a side profile view of a golf club face groove having a sharp triangular profile.

FIG. 2 illustrates the lower portion of a golf club. FIG. 2 shows a club head 201, a hosel 203 and a portion of the shaft 204 of the club 200. A front face of the club head 201 includes a plurality of parallel grooves 202 above a sole 205 of the club 200. The dimensions of the grooves 202 are governed by rules promulgated by golf authorities, such as the United States Golf Association ("USGA"). Current USGA rules, specifically USGA Equipment Rule 5 (2019), which is incorporated herein by reference in its entirety, require the grooves 202 to be straight and parallel and to have symmetrical sides which do not converge. The USGA current rules also require that the width of each groove not exceed 0.9 mm and that the distance between adjacent grooves must not be less than three times the width of the grooves and not less than 0.075 mm.

FIGS. 3A, 3B, 3C, and 3D illustrate cross-section examples of grooves 202 that are acceptable under current USGA rules. While golf authority rules do provide limitations on the configuration of the golf club, this does not mean that the clubs are entirely uniform, with variations within the tolerance of the rules accepted. The grooves shown in FIGS. 3A-3D provide one such example of a lack of uniformity that provides a particular challenge for affixing an apparatus to the club face, especially in providing an apparatus capable of adapting to affix to different clubs sold by different companies.

Figure 4:
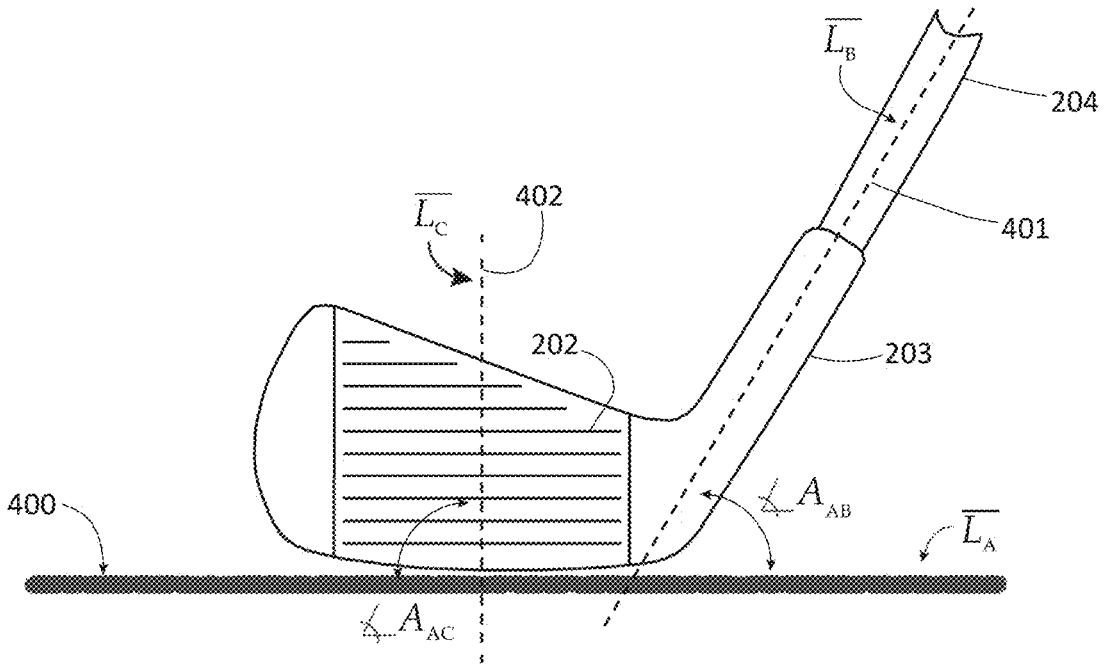
FIG. 4 illustrates a front view of a lower portion of a golf club with the lie angle of the golf club indicated.

FIG. 4 illustrates the lie angle (angle $A_{AB}$ in FIG. 4) of a golf club. The lie angle is the angle formed by the intersection of a line 401 running down the center of shaft 204 and a line 400 which is the line formed by the ground, where the golf club is positioned such that grooves 202 are parallel to line 400. Therefore, when properly positioned for lie measurement, the grooves 202 form a 90° angle (angle $A_{AC}$ in FIG. 4) and are thus perpendicular to line 402.

Because the apparatus of the present invention aligns itself with the grooves 202 of the club and the position of the IMU sensor relative to the apparatus is known, there is an effective automatic alignment of the sensor to be parallel with the grooves 202, thereby allowing the golf club to be placed in any position in making a measurement.

Figure 5:
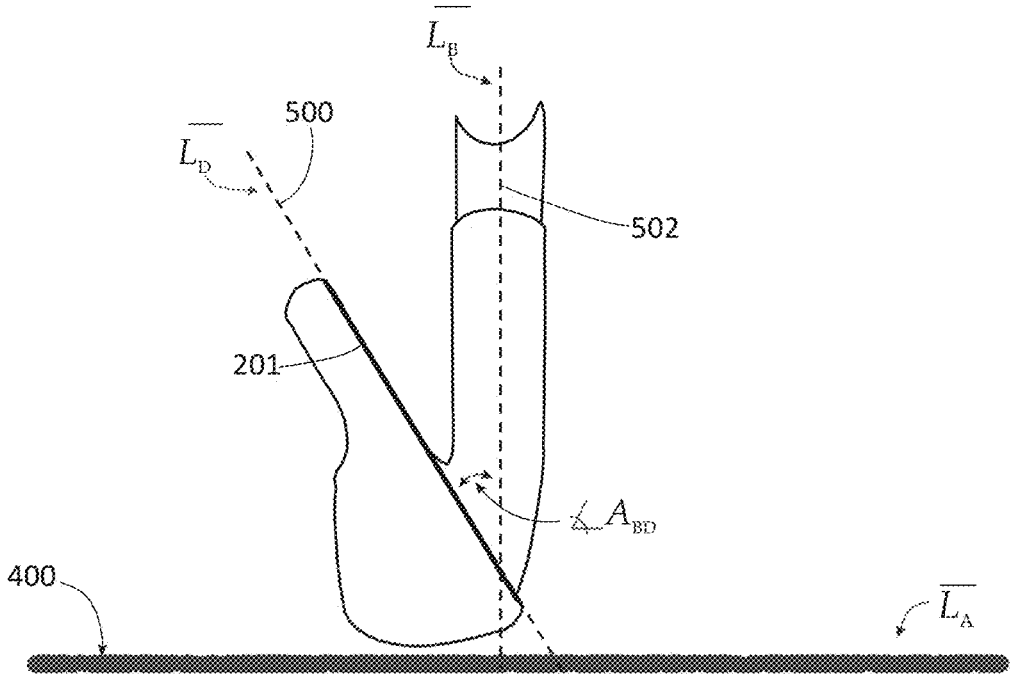
FIG. 5 illustrates a side view of a lower portion of a golf club with the loft angle of the golf club indicated.

FIG. 5 illustrates the loft angle (angle $A_{BD}$ in FIG. 5) of a golf club. The loft angle is the angle formed by the intersection of a line 502 running down the center of shaft 204 and a plane 500 of the club face 201. Together with the lie angle, the loft angle represents one of the important parameters that sensors need to recognize to properly calibrate the positioning of the golf club.

Figure 6:
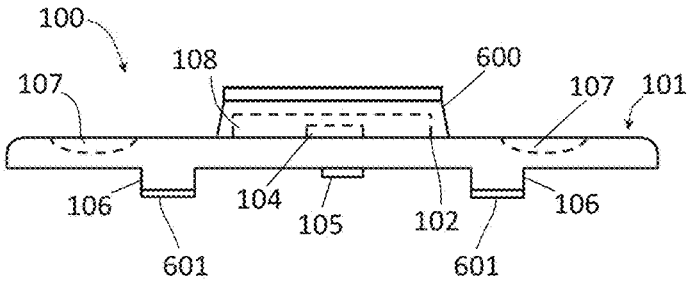
FIG. 6 illustrates a side orthogonal view of an apparatus for holding an inertial measurement unit on a golf club face according to one embodiment of the present invention.

FIG. 6 illustrates a side view of the apparatus of the present invention. The apparatus 100 includes a substrate 101 from which a circular wall 102 extends upward from the front surface of the substrate 101 to receive IMU 600. Located within wall 102 is a magnet 104. The magnet 104 is sized and located to leave an opening 108 between magnet 104 and the inside wall of wall 102 to receive the threaded portion 900 (shown on FIG. 9) of IMU 600. The substrate 101 is preferably made of a material that permits the magnet 104 to pull on a metal surface, such as the club face of a golf club. In one embodiment, the substrate 101 itself is not ferromagnetic (but is, for example, diamagnetic) such that the substrate does not shield the golf club from the magnetic field generated by the magnet 104. In another embodiment, the substrate 101 is ferromagnetic. The surface of substrate 101 includes two recesses 107, defined into the left and right sides of the front face of the substrate 101, to assist the user in holding the apparatus 100 on the golf club face during calibration. A plurality of tabs 106 (e.g., two tabs) extending outwardly from a back surface of the bottom edge of the apparatus 100. The plurality of tabs 106 are used to align the apparatus 100 with the grooves of the club face. Extensions 601 extend from the end of the tabs 106 and are sized so that they are able to be wholly or partially fitted within a groove of the club face. In one embodiment of the present invention, there are two tabs 106, each with an extension 601. In another embodiment of the present invention, there are three tabs, each with an extension. In yet another embodiment of the present invention, there is a single tab with a plurality of extensions. In another embodiment, there are no extensions 601, and the tabs 106 themselves are either sized to fit within a groove or are tapered such that the end of the tabs 106 are sized to fit, wholly or partially, within the groove. In still another embodiment of the present invention, tabs 106 are designed to fit along the sole of the golf club or another edge of the clubface. A pad 105 extends from a back face near the top of the substrate 101, on the opposite end of the back face as the tabs 106. In one embodiment, the pad 105 is sized relative to tabs 106 to level the apparatus 100 on the club face.

Figure 7:
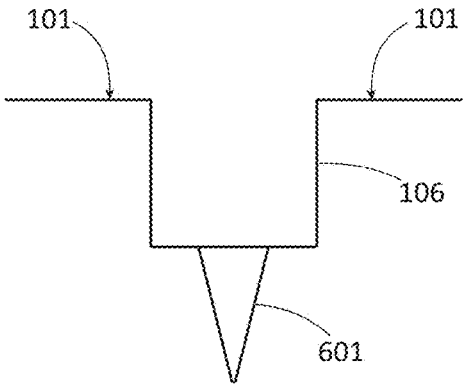
FIG. 7 illustrates a side enlarged view of an extension of an apparatus configured to fit into a golf club face groove according to one embodiment of the present invention.

FIG. 7 illustrates a cross-section of a tab and an extension therefrom of the apparatus of the present invention. As shown in FIG. 7, in one embodiment, the extension is triangle shaped to fit wholly or partially within a groove. One skilled in the art will recognize that extension 601 can be any shape that is sized to fit wholly or partially within groove 202. In one embodiment the purpose of tab 106 and extension 601 is to provide more stability to the apparatus during calibration and to align the apparatus, and particularly the IMU, with the grooves on the club face. This alignment is preferably achieved by placing the apparatus on the club face, such that the tabs 106, and particularly the extensions 601, are fit wholly or partially within a single groove. One of ordinary skill in the art will understand that while the extension 601 shown in FIG. 7 is depicted as having a triangular cross-section, extensions having other cross-sections are also contemplated herein, preferably as best allows them to adapt to different groove shapes. In one embodiment, the extensions 601 and/or the tabs 106 are able to be replaced with extensions 601 or tabs 106 having different shapes, as is needed to adapt to particular groove shapes. Alternatively, the triangular shaped extensions 601 shown in FIG. 7 are able to be used with any shape of groove as a suitable alignment tool.

Figure 8:
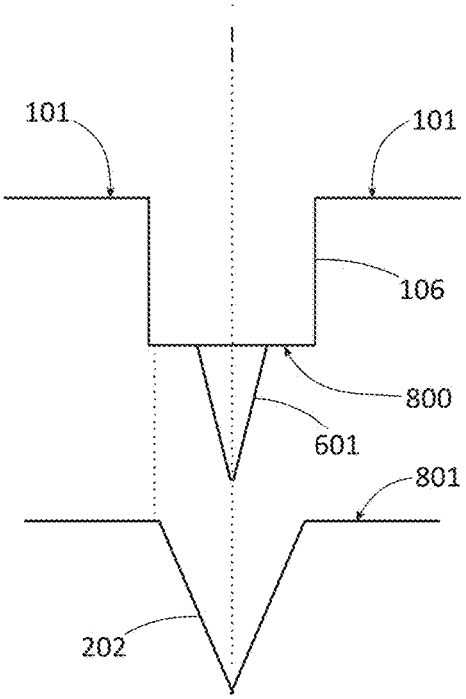
FIG. 8 illustrates a side enlarged view of an extension of an apparatus fitting into a golf club face groove according to one embodiment of the present invention.

FIG. 8 illustrates a view of how a tab and particularly an extension fits wholly or partially within groove 202. In the preferred embodiment, shoulders 800 of the tab 106 rest on shoulders 801 of the groove 202. The shoulders 801 of the grooves 202 are formed by the front surface of the club face. One skilled in the art will recognize that it is not necessary for the extension 601 to fit wholly within the groove 201 but, preferably, a sufficient portion of the extension 601 will fit within the groove 202 to prevent the substrate from sliding along the club face. However, given the small dimensions of the groove 202, sliding within the wider axis of the groove 202 will be understood by one skilled in the art to still fall within the parameters of the present invention.

Figure 9:
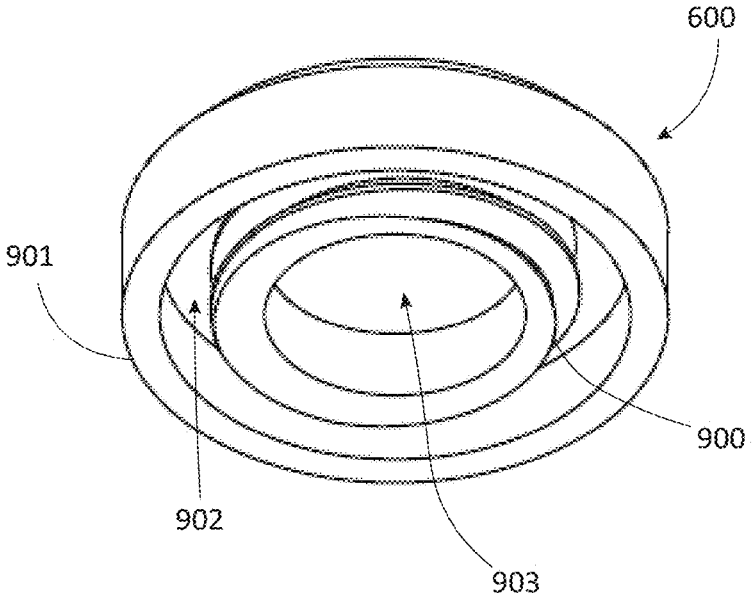
FIG. 9 illustrates a bottom perspective view of an outer shell of an inertial measurement unit (IMU) according to one embodiment of the present invention.

FIG. 9 illustrates an outer shell of an IMU. In the preferred embodiment of the present invention, the outer shell of the IMU 600 includes five sections. The five sections include an outer wall 901, a threaded extension 900 threaded to screw the threads of the wall of the substrate, an inner section (not shown on FIG. 9) with a floor (not shown on FIG. 9) for housing the IMU sensors, and a space 902 underneath the floor, between the outer wall 901 and the threaded extension 900. In the preferred embodiment, a hollow inner section 903 of the threaded extension 900 receives the magnet attached to the substrate, and the space 902 receives the threaded walls extending from the substrate.

Figure 10:
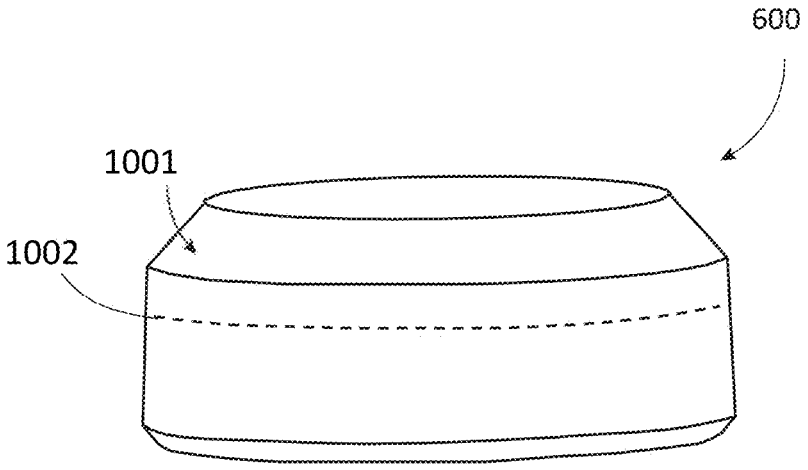
FIG. 10 illustrates a side orthogonal view of an outer shell of an inertial measurement unit (IMU) according to one embodiment of the present invention.

FIG. 10 illustrates the outer shell of an IMU. Inside the outer shell 600 is a compartment 1001 with a floor 1002 that houses the sensors of the IMU 600.

Figure 11:
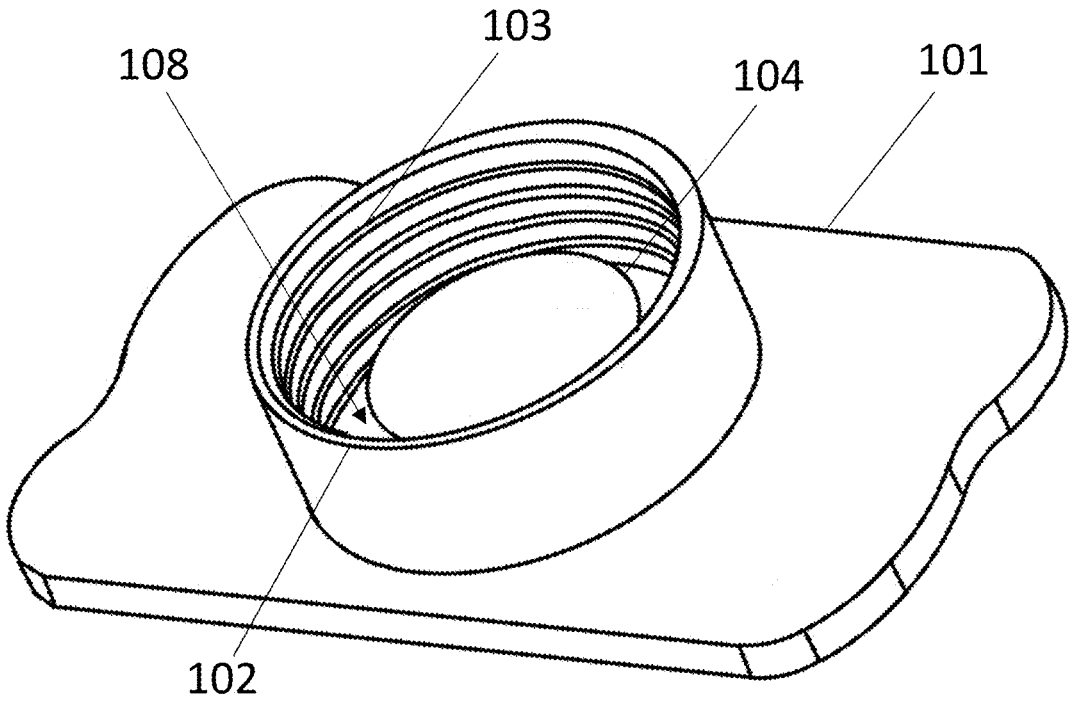
FIG. 11 illustrates a substrate of an apparatus configured to receive an inertial measurement unit according to one embodiment of the present invention.

FIG. 11 illustrates a cut-out of a substrate of the present invention showing the area which receives the IMU. In the preferred embodiment of the present invention, the area which receives the IMU includes a substantially circular area formed by an outer wall 102 with threads 103 defining an interior area 108 with a magnet 104. The threads 103 on the inner side of the outer wall 102 are configured to receive and engage with the threads of the IMU. The magnet 104 is sized and positioned in the preferred embodiment such that the side wall of the IMU sits on the base of the substrate 101 and fits between the threads 103 and the magnet 104.

Figure 12:
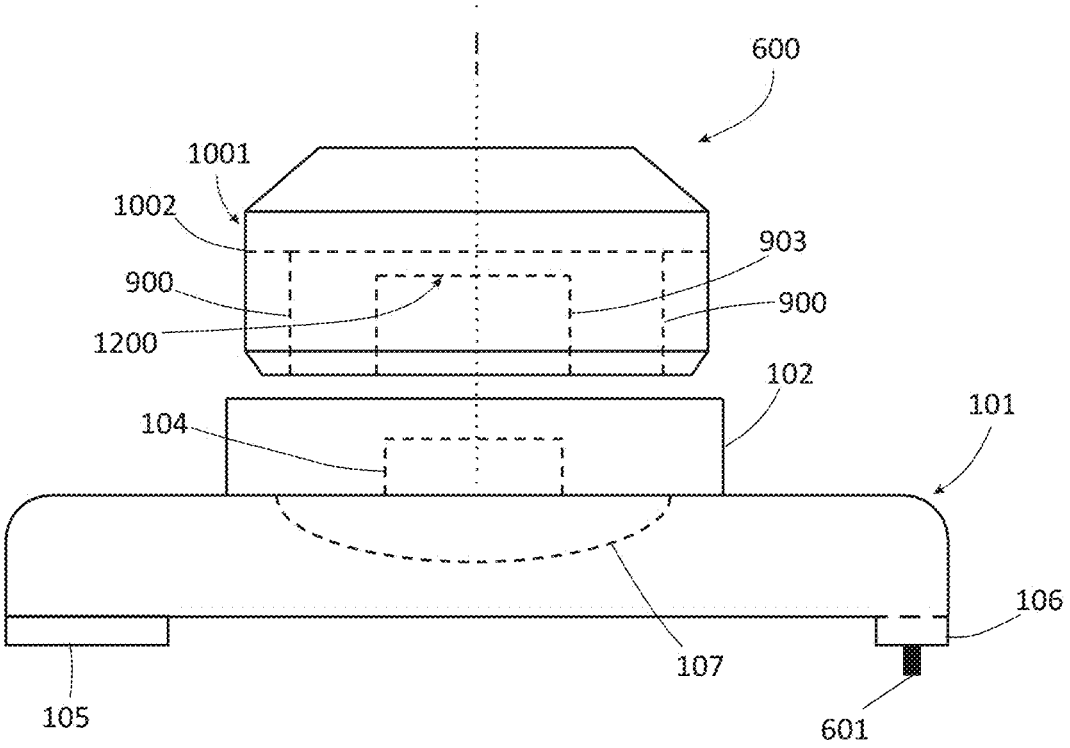
FIG. 12 illustrates a side transparent view of an inertial measurement unit (IMU) fitting into a substrate of an apparatus according to one embodiment of the present invention.

FIG. 12 illustrates a side view of a substrate and a view of how an IMU is received by the substrate, particularly by the circular area formed by the outer wall of the substrate. The circular threaded walls 900 of the IMU 600 define an inner open space 903 that is sized and located to fit over the magnet 104 on the substrate. In one embodiment illustrated in FIG. 12, threaded walls 900 extend from a floor 1200 of the IMU 600. In another embodiment, the threaded walls 900 do not have a separate floor and the floor 1002 that forms the floor for the internal sensor compartment 1001, also acts as the floor of the threaded walls 900. Also illustrated in FIG. 12 are side views of one recessed area 107 of the substrate 101, a tab 106 with an extension 601, and a pad 105.

Figure 13:
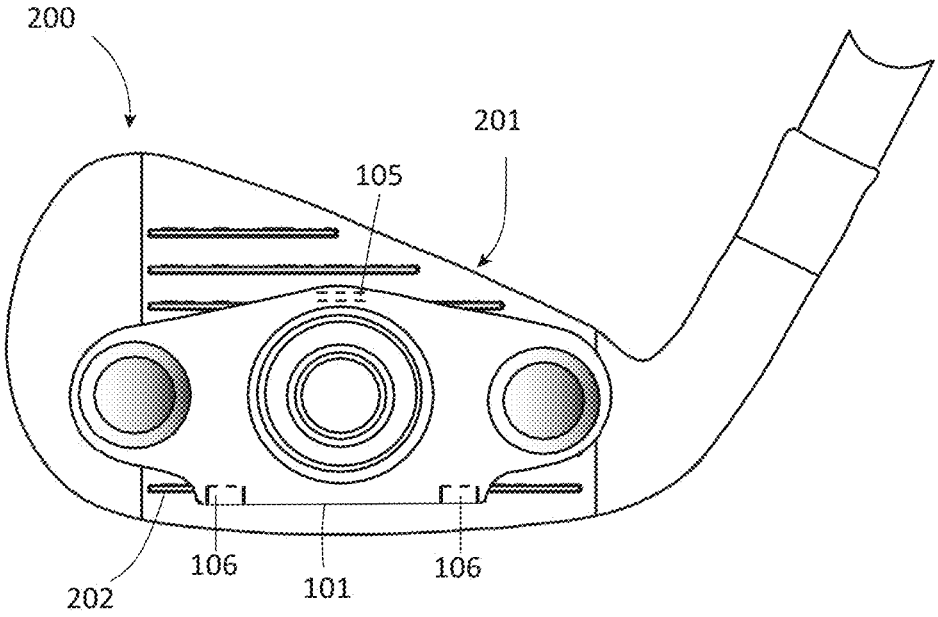
FIG. 13 illustrates a side view of an apparatus holding an inertial measurement unit (IMU) to a face of a golf club according to one embodiment of the present invention.

FIG. 13 illustrates a substrate of an apparatus of the present invention properly placed on a club face of a golf club during calibration. FIG. 13 is shown without an attached IMU for illustration purposes only. To calibrate the IMU attached to the grip end of the club 200, the substrate 101 is configured to receive the IMU preferably before placing substrate 101 on the club face 201. The tabs 106 extending off the substrate 101 are placed into the grooves 202, preferably, though not necessarily, the bottommost groove 202, such that the extensions of the tabs 106 are inserted wholly or partly within the grooves 201. The tab 105 rests on the surface of the club face 201 to help level the substrate 101. Alternatively, in one embodiment, the tabs 106 are positioned such that they engage with an edge of the club face.

The IMU in the apparatus of the present invention is able to communicate sensor data alone or in conjunction with a grid end IMU sensor to a user device or a server for performing calibration for analyzing a golf stroke. In this way, the present invention is able to be used in conjunction with the system discussed in U.S. patent application Ser. No. 18/390,900, which is incorporated herein by reference in its entirety.

Figure 14A:
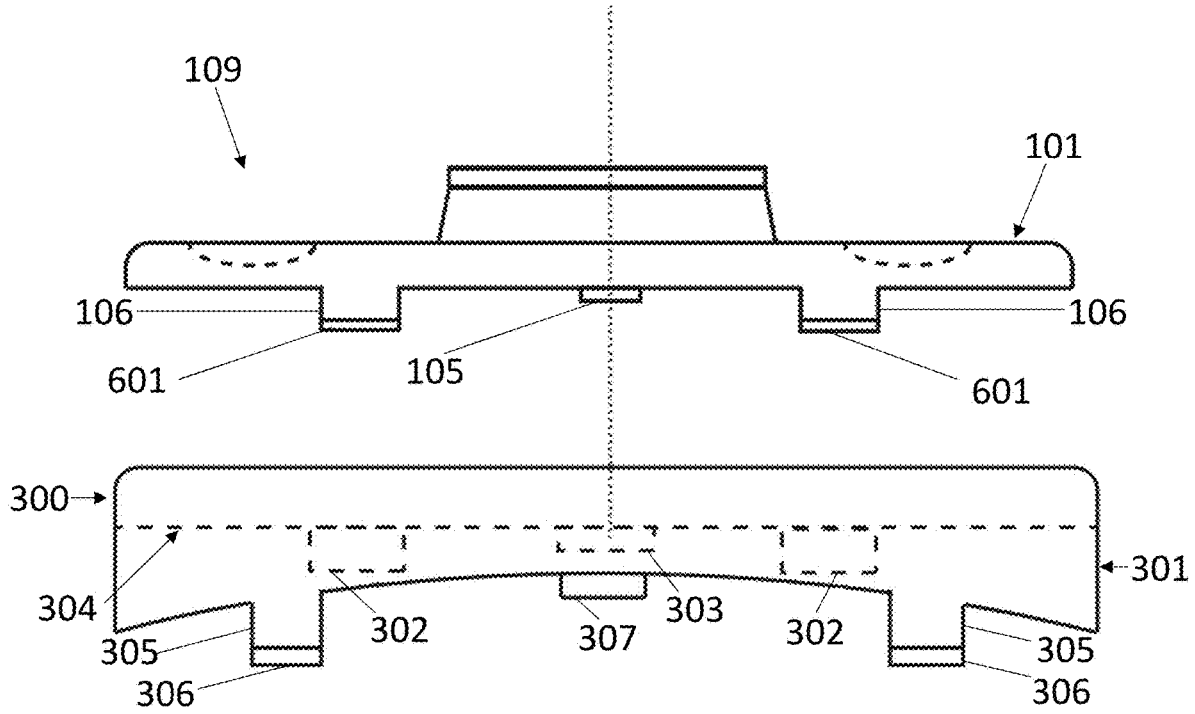
FIG. 14A illustrates a front orthogonal view of an apparatus for holding an inertial measurement unit on a golf club face, comprising two substrates, according to one embodiment of the present invention.

FIG. 14A illustrates a bottom view of the apparatus of the present invention that includes two substrates. The apparatus is able to be used with only the top substrate, or used by using the top and bottom substrate together. The top substrate includes an approximately flat bottom surface able to be used with golf club faces that are approximately flat, and the bottom substrate includes a bottom surface that is curved to approximately match curved golf club faces. The apparatus 109 includes two substrates 101, 300, in which the top substrate 101 is fitted onto and received by the bottom substrate 300. The top substrate 101 includes a plurality of tabs 106 (e.g., two tabs) extending outwardly from a bottom surface of the top substrate 101. The plurality of tabs 106 are used to align the apparatus 100 with the grooves of the club face when used without the bottom substrate 300 and to be fitted into recesses 302, 303 in the bottom substrate 300 when used with the bottom substrate 300. Extensions 601 extend from ends of the tabs 106 and are sized so that they are able to be wholly or partially fitted within a groove of the club face. In one embodiment of the present invention, there are two tabs 106, each with an extension 601. In another embodiment of the present invention, there are three tabs, each with an extension. In yet another embodiment of the present invention, there is a single tab with a plurality of extensions. In another embodiment, there are no extensions 601, and the tabs 106 themselves are either sized to fit within a groove or are tapered such that the end of the tabs 106 are sized to fit, wholly or partially, within the groove. In still another embodiment of the present invention, tabs 106 are designed to fit along the sole of the golf club or another edge of the clubface. A pad 105 extends from a back face near the top of the substrate 101, on the opposite end of the back face as the tabs 106. In one embodiment, the pad 105 is sized relative to tabs 106 to level the apparatus 100 on the club face. The bottom substrate includes side wall 301 that extends upward from the substrate, leaving a recessed area with a surface 304 large enough to accommodate the bottom surface of top substrate 101 when top substrate 101 is used with bottom substrate 300. The surface 304 of bottom substrate 300 includes recessed areas 302, 303 that are sized to receive, and which receive, tabs 105, 106 of top substrate 101. The bottom surface of substrate 300 is curved to approximate the curve of golf club faces that have curved surfaces, such as is common for some drivers and fairway woods. Similar to top substrate 101, bottom substrate 300 includes a plurality of tabs 305 (e.g., two tabs) extending outwardly from a back surface of the bottom edge of substrate 300. The plurality of tabs 305 are used to align the apparatus 109 with the grooves of the club face. Extensions 306 extend from the end of the tabs 305 and are sized so that they are able to be wholly or partially fitted within a groove of the club face. In one embodiment of the present invention, there are two tabs 305, each with an extension 306. In another embodiment of the present invention, there are three tabs, each with an extension. In yet another embodiment of the present invention, there is a single tab with a plurality of extensions. In another embodiment, there are no extensions 306, and the tabs 305 themselves are either sized to fit within a groove or are tapered such that the end of the tabs 305 are sized to fit, wholly or partially, within the groove. In still another embodiment of the present invention, tabs 305 are designed to fit along the sole of the golf club or another edge of the clubface. A pad 307 extends from a back face near the top of the substrate 300, on the opposite end of the back face as the tabs 305.

Figure 14B:
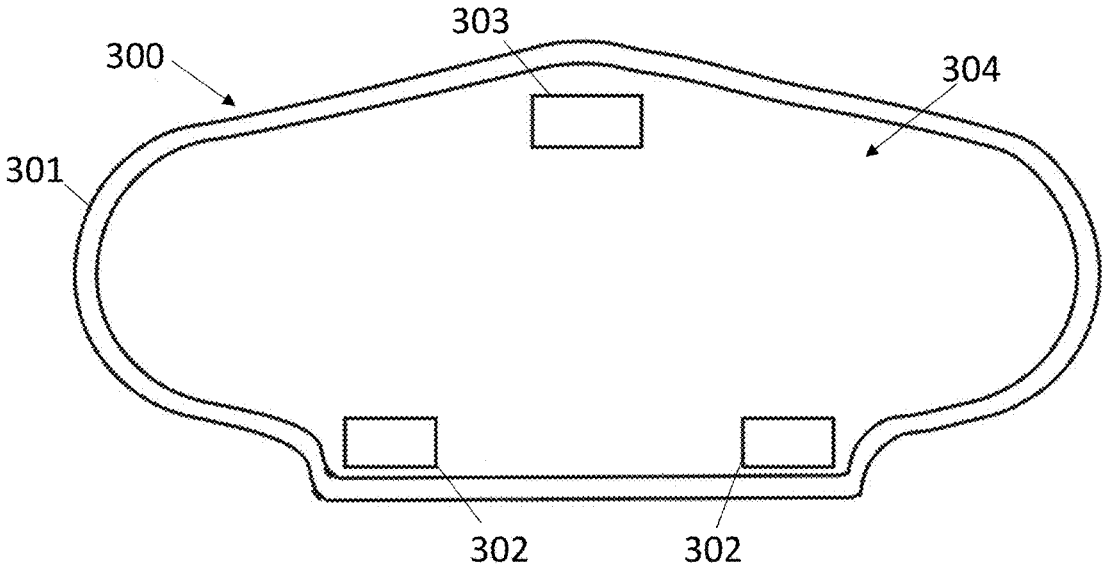
FIG. 14B illustrates a top perspective view of the bottom substrate of an apparatus for holding an inertial measurement unit on a golf club face, comprising two substrates, according to one embodiment of the present invention.

FIG. 14B illustrates top view of bottom substrate 300 of the apparatus of the present invention that includes two substrates. The bottom substrate includes a side wall 301 that extends upwardly from the substrate, leaving a recessed area with a surface 304 large enough to accommodate the bottom surface of top substrate 101 (shown in FIG. 14A) when top substrate 101 is used with bottom substrate 300. The surface 304 of the bottom substrate 300 includes recessed areas 302, 303 that are sized to receive, and which receive, tabs 105, 106 (shown in FIG. 14A) of top substrate 101.

Figure 15:
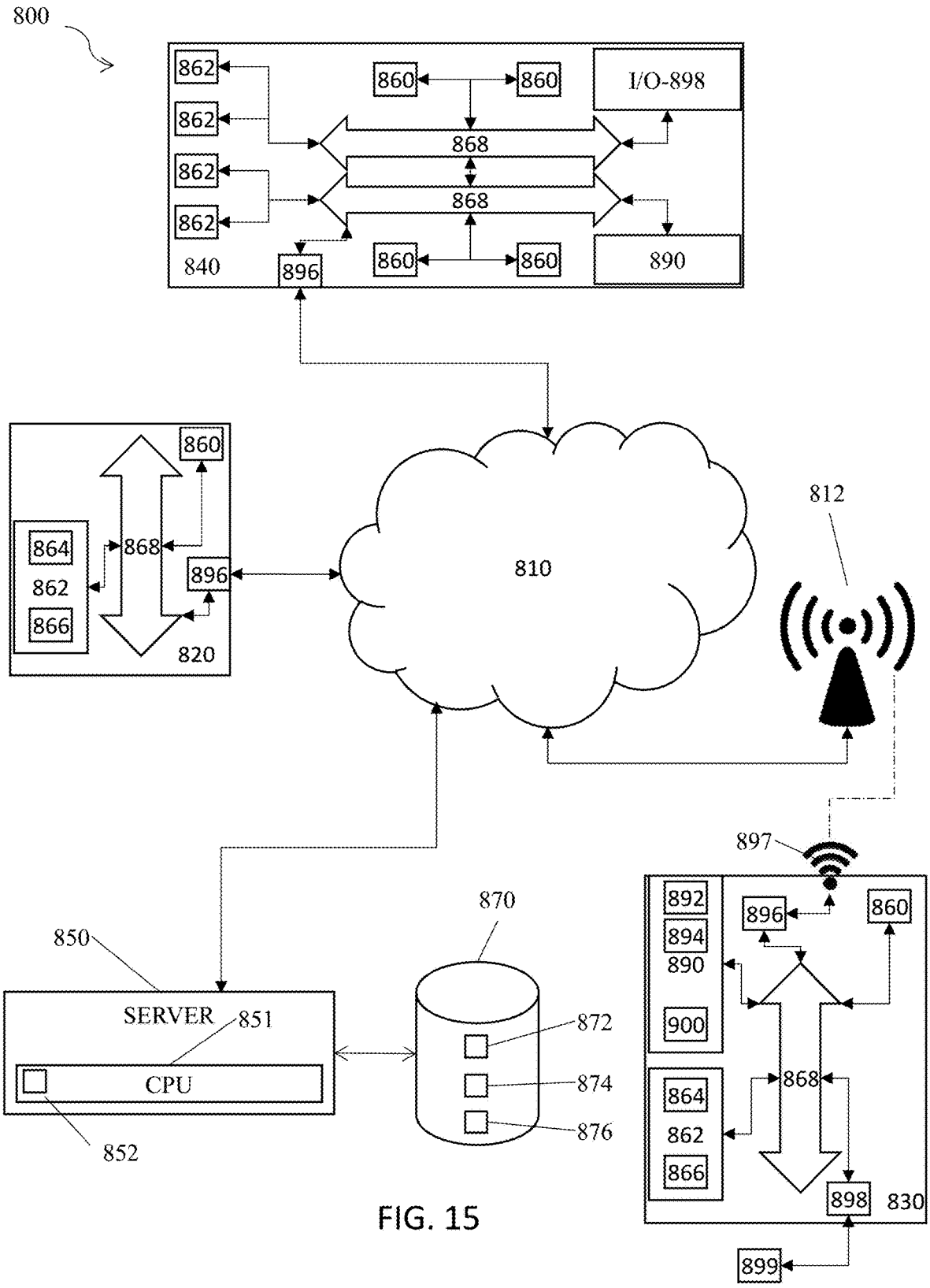
FIG. 15 is a schematic diagram of a system of the present invention.

FIG. 15 is a schematic diagram of an embodiment of the invention illustrating a computer system, generally described as 800, having a network 810, a plurality of computing devices 820, 830, 840, a server 850, and a database 870.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 is operable to house an operating system 872, memory 874, and programs 876.

In one embodiment of the invention, the system 800 includes a network 810 for distributed communication via a wireless communication antenna 812 and processing by at least one mobile communication computing device 830. Alternatively, wireless and wired communication and connectivity between devices and components described herein include wireless network communication such as WI-FI, WORLDWIDE INTEROPERABILITY FOR MICROWAVE ACCESS (WIMAX), Radio Frequency (RF) communication including RF identification (RFID), NEAR FIELD COMMUNICATION (NFC), BLUETOOTH including BLUETOOTH LOW ENERGY (BLE), ZIGBEE, Infrared (IR) communication, cellular communication, satellite communication, Universal Serial Bus (USB), Ethernet communications, communication via fiber-optic cables, coaxial cables, twisted pair cables, and/or any other type of wireless or wired communication. In another embodiment of the invention, the system 800 is a virtualized computing system capable of executing any or all aspects of software and/or application components presented herein on the computing devices 820, 830, 840. In certain aspects, the computer system 800 is operable to be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of electronic devices including at least a processor and a memory, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in the present application.

In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 is operable to additionally include components such as a storage device 890 for storing the operating system 892 and one or more application programs 894, a network interface unit 896, and/or an input/output controller 898. Each of the components is operable to be coupled to each other through at least one bus 868. The input/output controller 898 is operable to receive and process input from, or provide output to, a number of other devices 899, including, but not limited to, alphanumeric input devices, mice, electronic styluses, display units, touch screens, gaming controllers, joy sticks, touch pads, signal generation devices (e.g., speakers), augmented reality/virtual reality (AR/VR) devices (e.g., AR/VR headsets), or printers.

By way of example, and not limitation, the processor 860 is operable to be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown as 840 in FIG. 15, multiple processors 860 and/or multiple buses 868 are operable to be used, as appropriate, along with multiple memories 862 of multiple types (e.g., a combination of a DSP and a microprocessor, a plurality of microprocessors, one or more microprocessors in conjunction with a DSP core).

Also, multiple computing devices are operable to be connected, with each device providing portions of the necessary operations (e.g., a server bank, a group of blade servers, or a multi-processor system). Alternatively, some steps or methods are operable to be performed by circuitry that is specific to a given function.

According to various embodiments, the computer system 800 is operable to operate in a networked environment using logical connections to local and/or remote computing devices 820, 830, 840 through a network 810. A computing device 830 is operable to connect to a network 810 through a network interface unit 896 connected to a bus 868. Computing devices are operable to communicate communication media through wired networks, direct-wired connections or wirelessly, such as acoustic, RF, or infrared, through an antenna 897 in communication with the network antenna 812 and the network interface unit 896, which are operable to include digital signal processing circuitry when necessary. The network interface unit 896 is operable to provide for communications under various modes or protocols.

In one or more exemplary aspects, the instructions are operable to be implemented in hardware, software, firmware, or any combinations thereof. A computer readable medium is operable to provide volatile or non-volatile storage for one or more sets of instructions, such as operating systems, data structures, program modules, applications, or other data embodying any one or more of the methodologies or functions described herein. The computer readable medium is operable to include the memory 862, the processor 860, and/or the storage media 890 and is operable be a single medium or multiple media (e.g., a centralized or distributed computer system) that store the one or more sets of instructions 900. Non-transitory computer readable media includes all computer readable media, with the sole exception being a transitory, propagating signal per se. The instructions 900 are further operable to be transmitted or received over the network 810 via the network interface unit 896 as communication media, which is operable to include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that can be used to store the computer readable instructions and which can be accessed by the computer system 800.

In one embodiment, the computer system 800 is within a cloud-based network. In one embodiment, the server 850 is a designated physical server for distributed computing devices 820, 830, and 840. In one embodiment, the server 850 is a cloud-based server platform. In one embodiment, the cloud-based server platform hosts serverless functions for distributed computing devices 820, 830, and 840.

In another embodiment, the computer system 800 is within an edge computing network. The server 850 is an edge server, and the database 870 is an edge database. The edge server 850 and the edge database 870 are part of an edge computing platform. In one embodiment, the edge server 850 and the edge database 870 are designated to distributed computing devices 820, 830, and 840. In one embodiment, the edge server 850 and the edge database 870 are not designated for distributed computing devices 820, 830, and 840. The distributed computing devices 820, 830, and 840 connect to an edge server in the edge computing network based on proximity, availability, latency, bandwidth, and/or other factors.

It is also contemplated that the computer system 800 is operable to not include all of the components shown in FIG. 15, is operable to include other components that are not explicitly shown in FIG. 15, or is operable to utilize an architecture completely different than that shown in FIG. 15. The various illustrative logical blocks, modules, elements, circuits, and algorithms described in connection with the embodiments disclosed herein are operable to be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. An apparatus for affixing a sensor to a golf club face, comprising:

a substrate;

a circular wall extending from a front surface of the substrate, defining a hollow central area of the substrate;

a magnet disposed in the hollow central area of the substrate; and one or more tabs extending from a back surface of the substrate, each including extensions configured to be inserted into and engage with one or more grooves on the golf club face or with an edge of the golf club face;

wherein an inner surface of the circular wall includes threading configured to engage with threading of an outer shell of an inertial measurement unit (IMU).

2. The apparatus of claim 1, wherein a pad extends from the back surface of the substrate, and wherein the pad is configured to contact the golf club face.

3. The apparatus of claim 1, wherein the one or more tabs includes two tabs located proximate to a bottom edge of the substrate.

4. The apparatus of claim 1, wherein the substrate includes a first recessed area defined in a left side of the front surface of the substrate, and a second recessed area defined in a right side of the front surface of the substrate.

5. The apparatus of claim 1, wherein the extensions have a substantially triangular cross-section.

6. The apparatus of claim 1, wherein the IMU is configured to transmit orientation data for the golf club face to a remote server or a remote user device.

7. The apparatus of claim 1, wherein, when attached to the apparatus, side walls of the outer shell of the IMU are configured to rest on the front surface of the substrate, between the circular wall and the magnet.

8. The apparatus of claim 1, wherein the substrate is not ferromagnetic.

9. An apparatus for affixing a sensor to a golf club face, comprising:

a substrate;

a circular wall extending from a front surface of the substrate, defining a hollow central area of the substrate;

a magnet disposed in the hollow central area of the substrate;

one or more tabs extending from a back surface of the substrate configured to engage with one or more grooves on the golf club face or with an edge of the golf club face; and a pad extending from the back surface of the substrate configured to contact the golf club face;

wherein an inner surface of the circular wall includes threading configured to engage with threading of an outer shell of an inertial measurement unit (IMU).

10. The apparatus of claim 9, wherein the one or more tabs includes two tabs located proximate to a bottom edge of the substrate.

11. The apparatus of claim 9, wherein the substrate includes a first recessed area defined in a left side of the front surface of the substrate, and a second recessed area defined in a right side of the front surface of the substrate.

12. The apparatus of claim 9, wherein the one or more tabs have a substantially triangular cross-section.

13. The apparatus of claim 9, wherein the IMU is configured to transmit orientation data for the golf club face to a remote server or a remote user device.

14. The apparatus of claim 9, wherein, when attached to the apparatus, side walls of the outer shell of the IMU are configured to rest on the front surface of the substrate, between the circular wall and the magnet.

15. The apparatus of claim 9, wherein the substrate is not ferromagnetic.

16. An apparatus for affixing a sensor to a golf club face, comprising:

a substrate;

a circular wall extending from a front surface of the substrate, defining a hollow central area of the substrate;

a magnet disposed in the hollow central area of the substrate; and one or more tabs extending from a back surface of the substrate configured to engage with one or more grooves on the golf club face or with an edge of the golf club face;

wherein an inner surface of the circular wall includes threading configured to engage with threading of an outer shell of an inertial measurement unit (IMU); and wherein, when attached to the apparatus, side walls of the outer shell of the IMU are configured to rest on the front surface of the substrate, between the circular wall and the magnet.

17. The apparatus of claim 16, wherein the one or more tabs includes two tabs located proximate to a bottom edge of the substrate.

18. The apparatus of claim 16, wherein the substrate includes a first recessed area defined in a left side of the front surface of the substrate, and a second recessed area defined in a right side of the front surface of the substrate.

19. The apparatus of claim 16, wherein the IMU is configured to transmit orientation data for the golf club face to a remote server or a remote user device.

20. The apparatus of claim 16, wherein the substrate is not ferromagnetic.

* * * * *